United States Patent [19]

Ward

[11] 4,157,635

[45] Jun. 12, 1979

[54] GRINDING MACHINE FOR GRINDING A HELICAL GROOVE IN A WORKPIECE OF TAPERING AXIAL SECTION

[76] Inventor: Maurice M. Ward, April Cottage, Ringwood Rd., Ferndown, Dorset, England

[21] Appl. No.: 829,189

[22] Filed: Aug. 30, 1977

[30] Foreign Application Priority Data

Aug. 31, 1976 [GB] United Kingdom ..... 36024/76

[51] Int. Cl.[2] ..... B24B 19/02

[52] U.S. Cl. ..... 51/95 LH; 51/DIG. 31

[58] Field of Search ..... 51/95 R, 95 LH, 95 WH, 51/95 TG, 232, DIG. 31; 90/11.56, 11.62; 33/174 S

[56] References Cited

U.S. PATENT DOCUMENTS

| | | | |
|---|---|---|---|
| 2,212,855 | 8/1940 | Chittenden | 51/95 LH |
| 2,232,704 | 2/1941 | Hughes | 51/95 TG |
| 2,330,921 | 10/1943 | Rickenmann | 51/95 LH X |
| 2,564,496 | 8/1951 | Murray | 51/95 LH X |
| 3,680,261 | 8/1972 | Ward | 51/95 LH |

*Primary Examiner*—Nicholas P. Godici

[57] ABSTRACT

A grinding machine for grinding a helical groove in a workpiece of tapering axial section, to give a conical cutter, has means for rotating the workpiece at a varying rate as it is advanced towards the grinding wheel. The rotating means includes a pinion in the workhead engaging with a rack extending across the machine. The rack is connected to a slide lockable in position along a pivotal arm, so that the end of the rack follows a circular path as the workpiece is advanced.

17 Claims, 5 Drawing Figures

FIG.3.
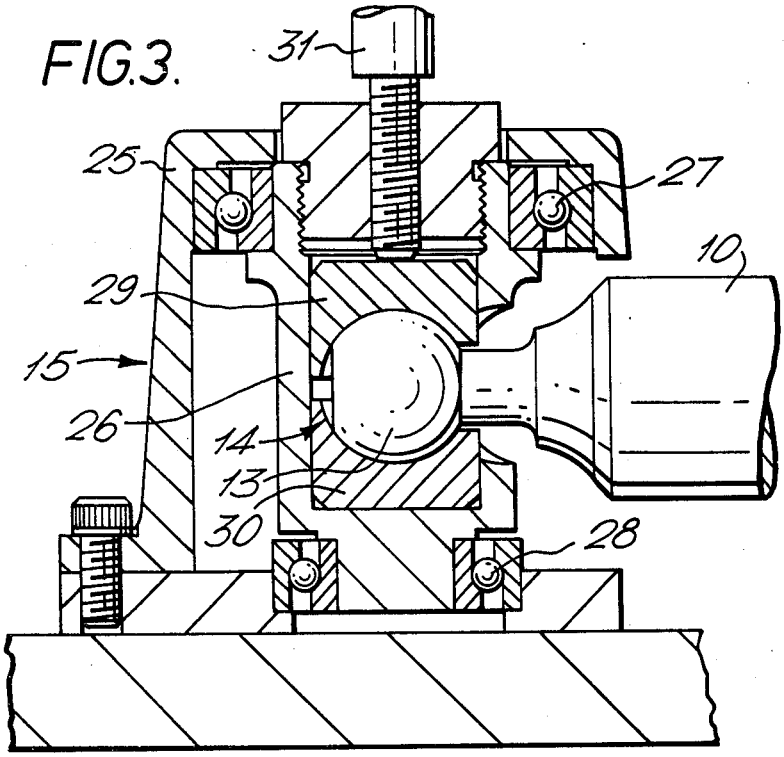
FIG.4.
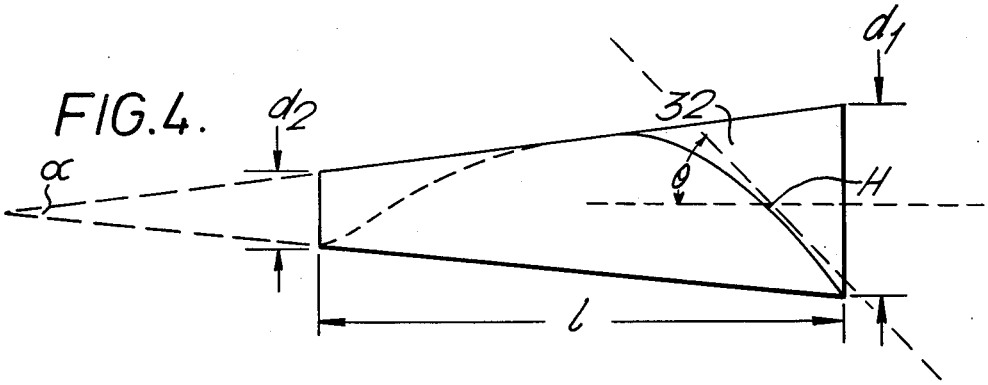
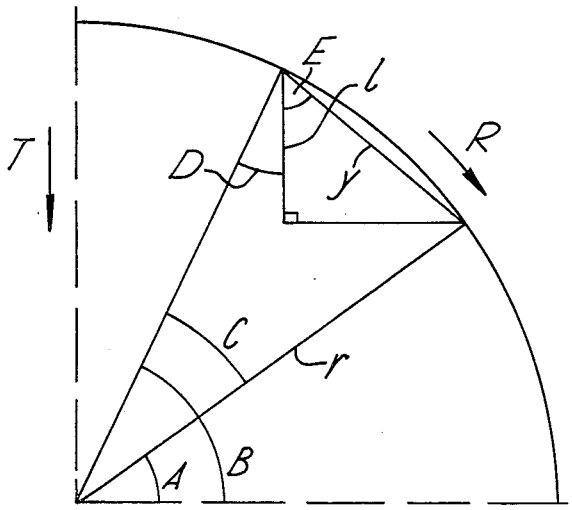
FIG.5.

GRINDING MACHINE FOR GRINDING A HELICAL GROOVE IN A WORKPIECE OF TAPERING AXIAL SECTION

This invention relates to grinding machines for grinding helical grooves in workpieces. More specifically the invention concerns improvements in machines of this type in which a spindle for mounting the workpiece to be ground is itself mounted for rotation about its axis and for rectilinear movement parallel to a vertical plane containing the spindle.

Such machines may include a so-called sine-bar which can be set at a chosen angle to the direction of rectilinear translation of the spindle, and which, by means of a follower, controls the rotation of the spindle concurrently with the translation of the latter. When using a machine of this type, difficulties may be encountered in obtaining a constant helix angle and rake angle when grinding conical workpieces such as taper reamers, taper die sink cutters and the like. Thus, the end of a cutter may have a negative rake angle cutting edge, giving the tip a greater likelihood of breaking off in service.

My U.S. Pat. No. 3,680,261 discloses one attempt to overcome this problem. A secondary sine bar is provided which alters the angle of the first sine bar to the direction of translation as such translation progresses, thus altering the rate of rotation of the spindle. This however results in somewhat complicated apparatus.

In my co-pending U.S. patent application Ser. No. 711,787 filed Aug. 5, 1976, and now abandoned there is disclosed a grinding machine which employs an arcuate sine bar. This sine bar can be altered in its angular position relative to the workpiece translation, and by suitable choice of angle and the portion of the sine bar employed, satisfactory results can be obtained with a reasonable range of cutters. However, for the required results with a wider range of cutters, ideally a number of sine bars of different radii should be employed, since even altering the angle of the sine bar may not be satisfactory.

According to the invention there is provided a grinding machine for grinding a helical groove in a workpiece of tapering axial section, comprising a rotatable spindle for mounting the workpiece for rotation about its axis, means for supporting a rotary grinding wheel to grind said groove in use, means for effecting rectilinear translation of said spindle with respect to said grinding wheel, and means for rotating the spindle concurrently with said rectilinear translation, said rotating means comprising a driving member operatively connected between said spindle and a point on a pivotally mounted arm, said arm being arranged to rotate about its pivotal axis concurrently with said rectilinear translation, whereby in use said point is constrained to move in an arcuate path of predetermined radius and said driving member has a component of movement in a direction serving to rotate said spindle.

Preferably the driving member can be adjustably secured to the arm at a number of positions corresponding to different radii. Thus, the arm may be in the form of a slideway on which is mounted a slide lockable in desired positions, the driving member being secured to the slide. The driving member is desirably pivotally secured to the slide, advantageously by means of a ball and socket connection—e.g. of the general type known from sine bar grinding machines.

Preferably, means are provided for guiding and stabilizing the arm, and may comprise one or more rollers carried by the arm engaging on a guide surface such as a curved bar. Advantageously the arm is stabilized against movement out of its plane of rotary movement, and thus the rollers could be V-grooved, and the curved bar have a double-chamfered edge on which the rollers engage.

A servo mechanism, such as an hydraulic or pneumatic motor, could be employed to assist in rotating the arm in use of the machine. This could be engaged by a suitable clutch mechanism when desired.

An embodiment of the invention will now be described by way of example and with reference to the accompanying drawings, in which:

FIG. 3 is a schematic detailed view of the ball and socket connection employed; and FIGS. 4 and 5 are diagrams for explaining how the method of operating the machine is determined.

Figure 1:
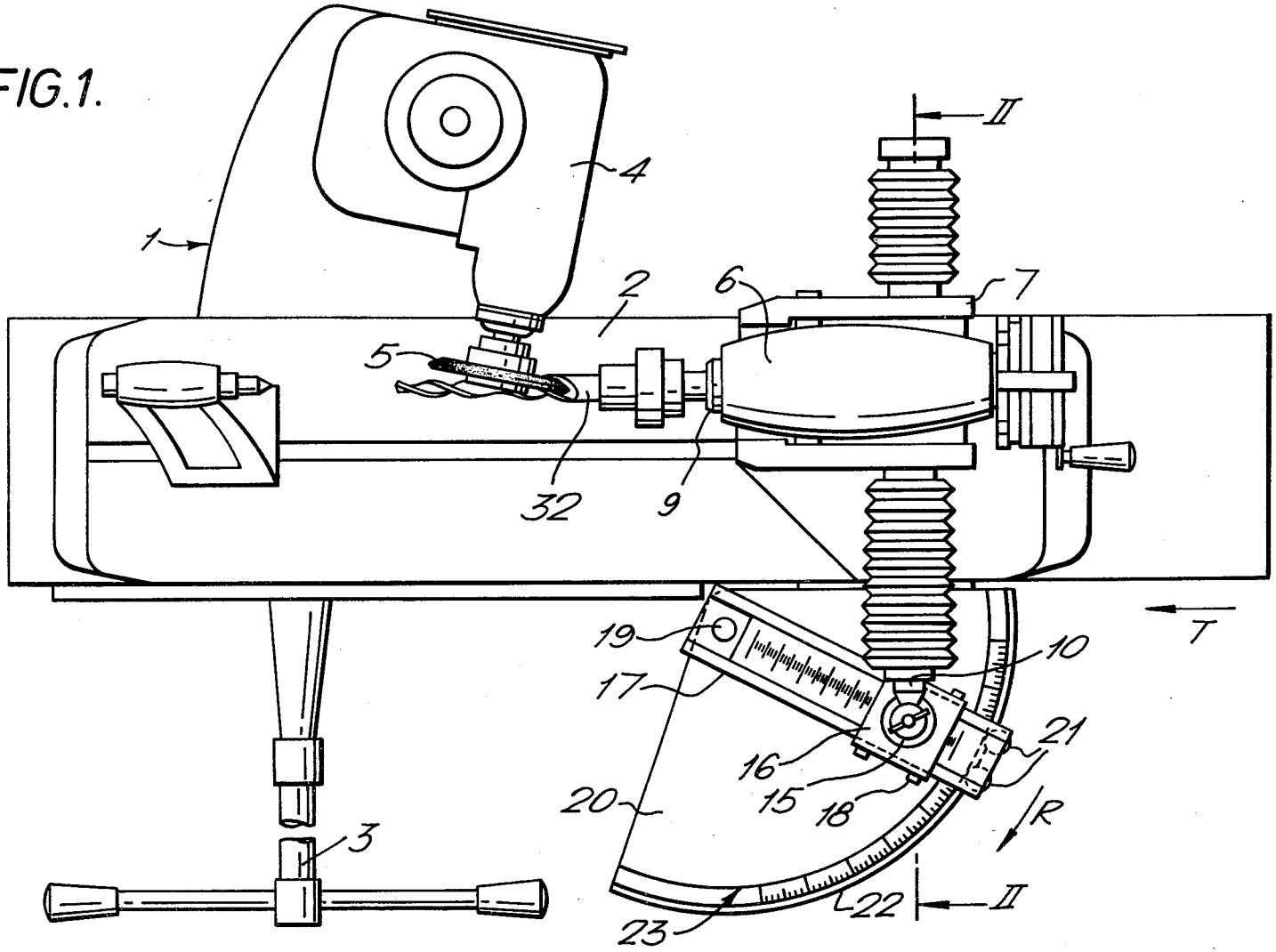
FIG. 1 is a schematic plan view of a grinding machine in accordance with the invention.
Figure 2:
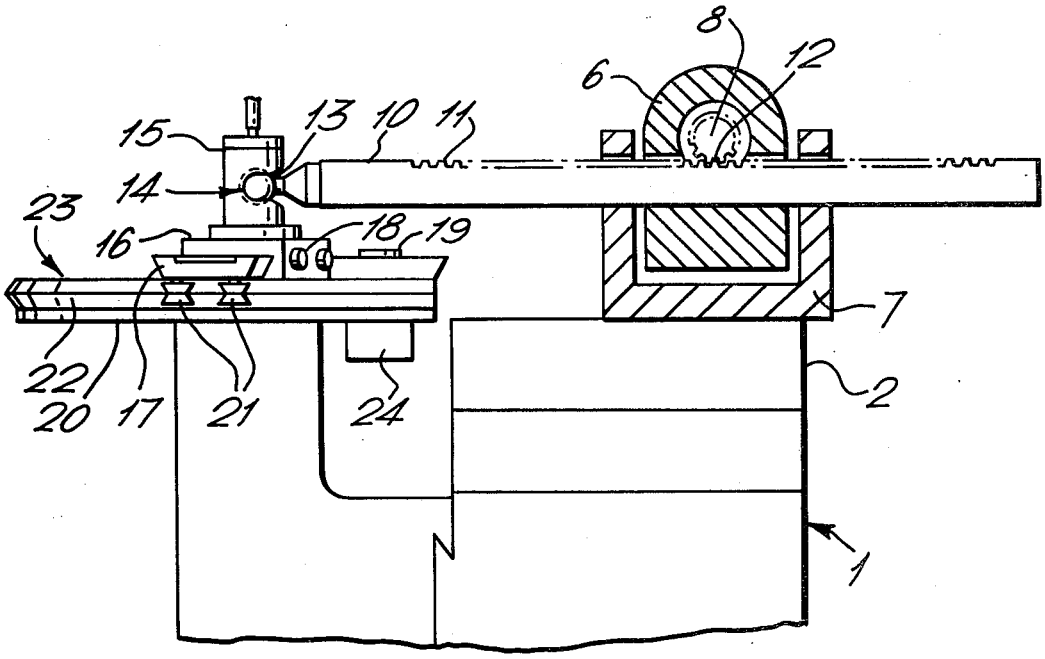
FIG. 2 is a schematic section along the line II—II of FIG. 1.

Referring now to the drawings, the grinding machine comprises a main bed 1 on which is supported a work table 2.

The work table is mounted for horizontal translation in the direction of its longitudinal axis, such translation being effect manually by means of a wheel 3. Alternatively the table could be translated by means of a hydraulic drive, preferably of the so-called "creep feed" type which will move the table slowly and under close control. The bed also carried a mounting 4 for a driven grinding wheel 5. In use, the grinding wheel is set at a required angle to the direction of translation. The wheel may be constructed with a formed grinding surface to enable the complete, finished groove to be made in a single pass of the table. Heretofore, with conventional wheels up to five passes have been necessary, giving rise to backlash problems.

A head 6 is mounted on a supporting structure 7 rigidly secured to the work table 2. The head houses a spindle 8 for carrying a workpiece via a chuck 9. The vertical plane containing the axis of the spindle is aligned with the direction of translation movement of the table 2. The spindle is mounted for rotation, this rotation being effected by means of a driving member in the form of a cross-bar 10, which carried a rack 11 engaging with a pinion 12 on the spindle 8. The gearing is 2.75 to 1. The cross-bar 10 extends are right angles to the direction of translation of the table 2, being mounted in a slideway in the head supporting structure 7.

One end of the cross-bar 10 is formed as a ball 13 engaging in a socket generally indicated at 14 in a member 15. Member 15 forms part of a slide 16 movable along a slideway 17 and lockable in position by means of locking screws 18.

Slideway 17 is pivotally mounted adjacent one end, at 19, on a table 20. The other end of slideway 17 is provided with V-grooved rollers 21 which engage on a double-chamfered edge 22 of an arcuate guide bar generally indicated at 23, secured to the edge of table 20. The slideway 17 is thus stabilised against bending movement out of the plane of its rotation about pivot mounting 19. An hydraulic motor 24 acts as a servo mechanism to assist rotation of slideway 17, driving through pivot mounting 19, and can be engaged as required by means of a dog clutch mechanism, (not shown).

As can be seen in greater detail in FIG. 3, the member 15 comprises an outer housing 25 in which is rotatably mounted a cup holder 26 by means of bearings 27 and 28. Cup holder 26 carries two hemispherical cups 29 and 30 for receiving ball 13 of cross member 10. A screw 31 is provided for tightening the cups around the ball.

In use of the machine, a conical workpiece 32 is mounted in the chuck 9. The head 6 can be pivoted in its supporting structure 7, and is set so that the axis of the workpiece 32 is at an angle to the direction of rectilinear translation such that the edge portion to be ground will lie parallel to such direction. Preferably the angle is somewhat less than half the cone angle; for example, with a cone angle of 10°, the angle is advantageously set to be 3½°. The grinding wheel 5 is set at the correct angle to the workpiece to give the required helix angle, and is rotated. The table 2 carrying the head and workpiece is then advanced in the direction of the arrow T, and as it does so, slideway 17 rotates in the direction of the arrow R, thus moving cross-bar 10 outwards and rotating the spindle 8 and work-piece 32. To give the correct helix, the angle at which slideway 17 is initially positioned, and the position of slide 16 along the slideway must be calculated.

Referring to FIGS. 4 and 5, the workpiece 32 on which is to be ground a helix H, of helix angle $\phi$, is of length l, and has an included angle $\alpha$. The diameters at either end are $d_1$ and $d_2$. Bearing in mind that there is a gearing of 2.75 between the rack on the cross-bar and the pinion, it can be shown that for the correct helix angle $\phi$ at the diameter $d_1$, the angular position of the slideway 17, i.e. angle A, is given by:

$$\text{Tan } A = \frac{2.75 \text{ Tan } \phi}{\pi d_1}$$

$$\therefore A = \text{Tan}^{-1}\left(\frac{2.75 \text{ Tan } \phi}{\pi d_1}\right) \quad (1)$$

Similarly, for the small end of the cutter:

$$\text{Tan } B = \frac{2.75 \text{ Tan } \phi}{\pi d_2}$$

$$\therefore B = \text{Tan}^{-1}\left(\frac{2.75 \text{ Tan } \phi}{\pi d_2}\right) \quad (2)$$

Thus for the arrangement shown in FIG. 1, with translation in the direction T, the slideway 17 should be set at angle B initially, with the grinding wheel at the tip of the workpiece. At the end of grinding, the slideway will have moved to angle A. To assist in setting up, the table 20 may be provided with angular markings, for example as shown along the guide bar 23.

To determine the radial setting of the slide 16, reference is made to FIG. 5. From this it can be seen that:

$$\angle C = B - A$$

$$\angle D = 90 - B$$

$$< E = \left(\frac{180 - C}{2}\right) - D$$

$$\therefore < E = \frac{1}{2}(A + B)$$

-continued $$y = \frac{l}{\cos E} = \frac{l}{\cos \frac{(A+B)}{2}}$$

$$r = \frac{\frac{y}{2}}{\sin \frac{C}{2}} = \frac{y}{2 \sin \frac{(B-A)}{2}}$$

$$= \frac{l}{2 \cos \frac{(A+B)}{2} \sin \frac{(B-A)}{2}}$$

$$\therefore r = \frac{l}{\sin B - \sin A} \quad (3)$$

Thus the radial setting can be easily calculated, and the slide positioned to give the correct arc to be followed by the end of the cross arm. A scale may be provided on the slideway 17, as shown in FIG. 1.

Thus for a specimen workpiece, the figures below are obtained:

Workpiece characteristics:
$l = 2.800$ ins.
$d_1 = 0.680$ ins.
$d_2 = 0.190$ ins.
Required helix angle $\phi = 25°$
From (1) $A = 31°$
From (2) $B = 65°$
From (3) $r = 7.157$ ins.

It can be seen that at least in the preferred embodiment the invention provides a versatile grinding machine which can accurately grind a helical groove in a wide range of workpieces and is relatively easy to set up to account for different parameters.

What I claim is:

1. A grinding machine for grinding a helical groove in a workpiece of tapering axial section, comprising a rotatable spindle for mounting the workpiece for rotation about its axis, means for supporting a rotary grinding wheel to grind said groove, means for effecting rectilinear translation of said spindle with respect to said grinding wheel, and means for rotating the spindle concurrently with said rectilinear translation, said rotating means comprising a driving member operatively connected between said spindle and a point on a pivotally mounted arm, said point being constrained to move in an arcuate path having a predetermined radius, said driving member having a component of movement in a direction providing for rotation of said spindle, said arm being in the form of a slideway on which is mounted a slide lockable in desired radial positions, the driving member being secured to the slide, and said arm being arranged to rotate about its pivotal axis concurrently with said rectilinear translation.

2. A grinding machine as claimed in claim 1, wherein the driving member is secured to the slide by means of a ball and socket connection.

3. A grinding machine as claimed in claim 2, wherein means securing said driving member to said slide comprises a housing, a holder rotatably supported in said housing by means of bearings, a pair of hemispherical cups adjustably mounted in said holder so as to form a socket, and means for tightening said cups around a ball formed on an end of said driving member.

4. A grinding machine as claimed in claim 3, including means for guiding and stabilising said arm.

5. A grinding machine as claimed in claim 4, wherein said guiding and stabilising means comprises at least one roller carried by the arm and engaging on an arcuate guide surface.

6. A grinding machine as claimed in claim 5, wherein the guide surface has a double chamfered edge and said at least one roller is formed with a V-groove engaging on said edge.

7. A grinding machine as claimed in claim 6, including a servo-motor connected to the arm, so as to assist in the rotation thereof.

8. A grinding machine for grinding a helical groove in a workpiece of tapering axial section comprising:

grinding means;

a rotatable spindle for mounting the workpiece for rotation about the axis of the workpiece;

means for effecting rectilinear translation of the spindle with respect to said grinding means;

drive means operatively connected to the spindle and capable of movement in a direction to provide for rotation of the spindle;

means for moving said drive means to provide for concurrent rectilinear translation and rotation of the spindle to allow the grinding means to form a helical groove in the workpiece; and wherein said means for moving said drive means comprises a pivotally mounted arm, and said drive means comprises an elongated cross-bar drivingly engaged with the spindle to provide for rotation of the spindle when the cross-bar is moved with respect to the spindle, the cross-bar being pivotally mounted to the arm at a point, said point being constrained to move in a circular path.

9. A grinding machine as in claim 8 wherein said point of mounting said cross-bar on said arm is radially adjustable.

10. A grinding machine as claimed in claim 9 wherein said arm is in the form of a slideway on which is mounted a slide lockable in desired radial positions, the cross-bar being secured to the slide.

11. A grinding machine as claimed in claim 10 wherein the cross-bar is secured to the slide by means of a ball and socket connection.

12. A grinding machine as claimed in claim 11, wherein means securing the cross-bar to the slide comprises a housing, a holder rotatably supported in said housing by means of bearings, a pair of hemispherical cups adjustably mounted in said holder so as to form a socket, and means for tightening said cups around a ball formed on an end of said cross-bar.

13. A grinding machine as claimed in claim 8, including means for guiding and stabilizing said arm.

14. A grinding machine as claimed in claim 13, wherein said guiding and stabilizing means comprises at least one roller carried by the arm and engaging on an arcuate guide surface.

15. A grinding machine as claimed in claim 14, wherein the guide surface has a double chamfered edge and said at least one roller is formed with a V-groove engaging on said edge.

16. A grinding machine as claimed in claim 8, wherein the cross-bar includes a rack drivingly engaging a pinion on the spindle.

17. A grinding machine as claimed in claim 8, wherein said arm is secured to a pivot mounting and a servo motor is drivingly connectible to the pivot mounting so as to assist rotation of the arm about its pivotal axis.

* * * * *